US006923165B1

(12) United States Patent
Draves et al.

(10) Patent No.: US 6,923,165 B1
(45) Date of Patent: Aug. 2, 2005

(54) FUEL SYSTEM FOR A MARINE PROPULSION DEVICE

(75) Inventors: Steven D. Draves, Fond du Lac, WI (US); John H. Gundert, Malone, WI (US)

(73) Assignee: Brunswick Corporation, Lake Forest, IL (US)

( * ) Notice: Subject to any disclaimer, the term of this patent is extended or adjusted under 35 U.S.C. 154(b) by 173 days.

(21) Appl. No.: 10/630,456

(22) Filed: Jul. 30, 2003

(51) Int. Cl.[7] ..... F02M 33/02
(52) U.S. Cl. ..... 123/510; 123/457
(58) Field of Search ..... 123/510, 511, 514, 123/457

(56) References Cited

U.S. PATENT DOCUMENTS

| | | | | |
|---|---|---|---|---|
| 4,502,451 | A * | 3/1985 | Duprez | 123/516 |
| 4,543,938 | A * | 10/1985 | Szlaga | 123/514 |
| 5,078,167 | A | 1/1992 | Brandt et al. | 137/549 |
| 5,339,787 | A * | 8/1994 | Jungquist et al. | 123/514 |
| 5,584,318 | A | 12/1996 | Brandt | 137/549 |
| 5,832,903 | A * | 11/1998 | White et al. | 123/514 |
| 5,964,206 | A | 10/1999 | White et al. | 123/541 |
| 6,029,629 | A * | 2/2000 | Tipton | 123/447 |
| 6,055,962 | A | 5/2000 | Kirk | 123/516 |
| 6,098,652 | A | 8/2000 | Brandt | 137/315.05 |
| 6,170,470 | B1 | 1/2001 | Clarkson et al. | 123/497 |
| 6,213,143 | B1 | 4/2001 | Schwegler et al. | 137/115.27 |
| 6,220,227 | B1 * | 4/2001 | Okada et al. | 123/509 |
| 6,250,287 | B1 | 6/2001 | Wickman et al. | 123/497 |
| 6,269,835 | B1 | 8/2001 | Kochsmeier | 137/549 |
| 6,306,292 | B1 | 10/2001 | Dell et al. | 210/137 |
| 6,311,725 | B1 * | 11/2001 | Hamada et al. | 137/565.13 |
| 6,431,147 | B1 | 8/2002 | Hiraiwa et al. | 123/458 |
| 6,527,603 | B1 | 3/2003 | Wickman et al. | 440/88 |

* cited by examiner

*Primary Examiner*—Thomas Moulis
(74) *Attorney, Agent, or Firm*—William D. Lanyi

(57) ABSTRACT

A fuel system is provided with a fuel distribution member that has a plurality of passages formed within its unitary structure to allow a water separating fuel filter and a pressure regulator to be attached directly to the fuel distribution member without the need of conduits and hoses connected therebetween. Fuel is received from a mechanical fuel pump and directed through the water separating fuel filter to a fuel manifold that includes first and second fuel rails. The fuel is cooled and pumped through a high pressure fuel filter as it flows to the fuel manifold. The pressure regulator has a pressure relief conduit that returns fuel to the fuel filter for recirculation.

20 Claims, 5 Drawing Sheets

FUEL SYSTEM FOR A MARINE PROPULSION DEVICE

BACKGROUND OF THE INVENTION

1. Field of the Invention

The present invention is generally related to a fuel system for a marine propulsion device and, more particularly, to a unitary fuel distribution member having a plurality of passages formed therein and having a pressure regulator attached thereto.

2. Description of the Prior Art

Many different types of fuel systems for internal combustion engines are well known to those skilled in the art. Typically, fuel is drawn from a fuel tank by a pump and provided, under pressure, to a series of components which can include a fuel cooler, an electric pump, a filter, and a pressure regulator. In certain types of internal combustion engines, such as those with fuel injectors, the pressurized fuel is provided to one or more fuel rails that distribute the fuel to the fuel injectors. In some cases, various components have been combined together in unitary structures in an effort to reduce the required space necessary for the components and also to reduce the number of conduits necessary to connect various components in fluid communication with each other.

U.S. Pat. No. 5,078,167, which issued to Brandt et al on Jan. 7, 1992, describes a fuel filter and pressure regulator system apparatus. A combination fuel pressure regulator and fuel filter apparatus for a vehicle fuel system has a fuel supply tank with a fuel pump therein for pumping fuel to a fuel supply rail having fuel injectors attached thereto. A fuel filter is operably disposed between an inlet supply tube and a fluid outlet tube for filtering impurities from fuel passing therethrough. A valve in fluid communication with the inlet supply tube is provided with a regulator for causing flow to be short circuited back into the fuel supply tank when the pressure in the fluid outlet exceeds a predetermined level. The valve is biased to a closed position and will remain closed as long as the pressure on the clean side of the filter is below the predetermined pressure whereby all of the fuel in the inlet supply tube will pass through the filter.

U.S. Pat. No. 6,431,147, which issued to Hiraiwa et al on Aug. 13, 2002, describes a fuel feed device and fuel pressure regulator. Mounted on the upper surface of the cover portion of a fuel supplying apparatus to be mounted to an opening portion of a fuel tank is a fuel pressure regulator which contains a fuel pressure detector portion constituted by a diaphragm portion detecting a pressure of the fuel discharged from the fuel pump and a current control portion for analogue-controlling the current flowing through the fuel pump by a signal from the fuel pressure detector portion. As a result, the fuel pump is set to pump an amount of the fuel corresponding to that required by the injector mounted to the engine, so that the current consumption of the fuel pump is reduced and the operating noise is lowered.

U.S. Pat. No. 6,306,292, which issued to Dell et al on Oct. 23, 2001, describes a fuel filter with internal pressure regulator. A fuel filter and pressure regulator assembly includes a housing, an inlet tube, and outlet and return tube each made of stainless steel. An annular filter element is disposed within the housing and abuts at one end a pressure regulator element which is mounted within an O-ring retainer that is fixed within the housing. A resilient device, such as a wave washer or O-ring, is compressed as the assembly is assembled. In operation, fuel flows in through an inlet tube which is radially offset at a first end of the housing and into an annular space around the annular filter element. The fuel then flows through the filter media and the filter element and out of the outlet tube which is aligned with a hollow core of the filter media. If fuel pressure is too high, the fuel then flows through the pressure regulator, out of the return tube and back to the fuel tank.

U.S. Pat. No. 5,584,318, which issued to Brandt on Dec. 17, 1996, describes a modular fuel filter and pressure regulator apparatus. The combination fuel pressure regulator and fuel filter apparatus is intended for use with a vehicle fuel system. The pressure regulator telescopes into the fuel filter and the two parts are separable and independently replaceable. The fuel filter is operably disposed between an inlet supply tube and an outlet tube for filtering impurities from fuel passing therethrough. A valve in fluid communication with the inlet tube is provided with a regulator for causing flow to be short circuited back into the supply tank when the pressure in the fuel outlet exceeds a predetermined level. The valve is biased to a closed position and will remain closed when the pressure on the clean side of the filter is below the predetermined pressure whereby all of the fuel in the inlet tube will pass through the filter when the pressure in the fluid outlet is below the predetermined pressure.

U.S. Pat. No. 6,269,835, which issued to Kochsmeier on Aug. 7, 2001, describes a pressure-regulating arrangement. In a pressure-regulating arrangement between a pump and a load, in particular between a fuel pump and an internal combustion engine, in which, if the flow from the pump exceeds a predetermined pressure, a cutoff quantity is branched off and fed back into a storage container. According to the invention the pressure regulator, together with the cutoff line, is combined with a filter in one structural unit. All three connections are preferably arranged on the same side of a common housing. In a particularly advantageous embodiment, all three connections are arranged coaxially with one another, so that if an appropriate connecting piece is used, installation faults can be ruled out.

U.S. Pat. No. 6,098,652, which issued to Brandt on Aug. 8, 2000, describes a quick connect fuel filter and regulator. A modular pressure regulator/filter is disclosed. The fuel filter is adapted to be attached to a fuel delivery system of an internal combustion engine and the housing thereof has a projecting wall on the filter housing adjacent to a female opening in the fuel filter housing. This projecting wall has at least one slot therein. A clip is provided and includes a disc portion with a central opening therein for selectively receiving a male outlet conduit from the pressure regulator. A clip projection, which is integral with and movably attached to the disc portion, is adapted to be selectively received into the slot in the projecting wall whereby the clip is held from moving away from the projecting wall. An annular projection of the pressure regulator housing is disposed between the disc portion and the clip projection when the clip projection is in the first position thereof for holding the pressure regulator housing in the clip. The clip therefore is used to selectively hold the pressure regulator housing and the filter housing together or allow them to be quickly and easily separated.

U.S. Pat. No. 6,213,143, which issued to Schwegler et al on Apr. 10, 2001, describes a liquid filter with integral pressure regulator. The filter with a built-in pressure regulator is disclosed. It is intended to be used with fuel, in which the pressure regulator with its diaphragm is mounted on the inside of a cap that has the inflow connector and the tank connector. The diaphragm, which experiences a flow on its inside, is acted upon by the pressure of the fuel on the clean side of the filter element, and the flow through the filter element is radially from the outside inward. Integrating the pressure regulator in the cap enables a simple, compact, economical design of the liquid lifter, through whose valve in the pressure regulator only cleaned fuel flows.

U.S. Pat. No. 6,250,287, which issued to Wickman et al on Jun. 26, 2001, describes a fuel delivery system for a marine engine. A fuel pump is housed within the structure of a portable fuel tank. The inlet of the pump is located in the lower portion of the tank and an outlet of the pump is connectable in fluid communication with a flexible conduit. An opposite end of the flexible conduit is connectable in fluid communication with the fuel system of an outboard motor. A water sensor and a fuel level sensor can be provided in conjunction with the pump and attached to the pump in certain embodiments. A fuel pressure regulator is connected in fluid communication with the outlet of the pump and also located within the structure of the portable fuel tank.

U.S. Pat. No. 6,527,603, which issued to Wickman et al on Mar. 4, 2003, discloses a fuel delivery system for a marine propulsion device. A fuel system for a marine propulsion system includes a reservoir that defines a cavity in which first and second fuel pumps are disposed. The first fuel pump is a lift pump which draws fuel from a fuel tank and pumps the fuel into the cavity of the reservoir. The second fuel pump is a high pressure pump which draws fuel from the cavity and pumps the fuel at a higher pressure to a fuel rail of an engine.

U.S. Pat. No. 6,170,470, which issued to Clarkson et al on Jan. 9, 2001, discloses a fuel supply system for an internal combustion engine. The fuel system provides first and second conduits that draw fuel from first and second positions, or locations, within a fuel reservoir. If water exists in the fuel reservoir, the second position is selected to be lower in the fuel reservoir than the first position so that accumulated water will be drawn through the second conduit under certain conditions, such as when the water is operating at a speed above the minimum threshold. The fuel reservoir can be a fuel tank or auxiliary fuel tank of a vehicle or watercraft or, alternatively, it can be the housing of a fuel/water separator.

U.S. Pat. No. 6,055,962, which issued to Kirk on May 2, 2000, discloses a fuel system for an internal combustion engine. A fuel system uses a vacuum source to draw fuel from a fuel tank into a fuel reservoir. By avoiding the need for a fuel tank to pump fuel from the fuel tank to the fuel reservoir, a common incidence of vapor lock is prevented. The vacuum is provided by a crankcase of a compressor.

U.S. Pat. No. 5,964,206, which issued to White et al on Oct. 12, 1999, discloses a fuel supply cooling system for an internal combustion engine. The system is provided with a heat exchanger disposed in a generally planer cavity within a base. A manifold attaches to the base and contains the generally planer cavity. A heat exchanger, which comprises a fuel conduit, is disposed within the cavity. As fuel flows from a fuel pump to a fuel injection system of an internal combustion engine, it passes through the fuel conduit which is bathed in a flow of coolant. Some of the fuel flows directly from the fuel conduit to the fuel injection system, but excess fuel flows through a pressure regulator and a filter before being passed through a pump again to recirculates through the fuel conduit of the cooler. The quantity of fuel stored within the volume of the fuel supply system is significantly reduced because of the location of the various components and the fact that the components, such as the filter, regulator, and pump are attached directly to the base of the system. This reduces the need for interconnecting tubing or hoses and the resulting reduced amount of fuel stored in the system can be cooled much more rapidly when the engine is restarted.

Many different types of fuel systems are well known to those skilled in the art. These fuel systems typically incorporate various types of heat exchangers, filters, regulators, pumps, and fuel rails. In addition, numerous hoses and other conduits are necessary to conduct fuel between these components of the fuel system. The fuel-related components and their associated conduits and hoses require space. It would therefore be significantly beneficial if a system could be provided that significantly reduces the number of hoses and conduits necessary for the fuel system and, in addition, which conveniently and efficiently provides a single modular device which includes a fuel distribution network of conduits, a fuel filter, and a pressure regulator that was easily connectable to other components of the fuel system.

The patents described above are hereby expressly incorporated by reference in the description of the present invention.

SUMMARY OF THE INVENTION

A fuel system for a marine propulsion device, made in accordance with the preferred embodiment of the present invention, comprises a fuel distribution member which has a first fluid passage connectable in fluid communication with a source of fuel, a second fluid passage connectable in fluid communication with an inlet of a fuel manifold of the marine propulsion device, a return fluid passage which is connectable in fluid communication with an outlet of the fuel manifold of the marine propulsion device, and a fuel pressure regulator fluid passage. A pressure regulator is attached to the fuel distribution member and disposed in pressure regulating relation with the fuel pressure regulation fluid passage. A filter attachment opening, formed within the fuel distribution member, is shaped to receive a fuel filter. A filter outlet passage, formed within the fuel distribution member, is connectable in fluid communication with an inlet of the fuel filter. A filter inlet passage is formed in the fuel distribution member which is connectable in fluid communication with an outlet of a fuel filter.

The fuel system can further comprise a low pressure fuel pump, a fuel cooler, a high pressure fuel pump, a high pressure fuel filter, and a low pressure fuel filter. The fuel manifold of the marine propulsion device can comprise first and second fuel rails connected in fluid communication with the second fluid passage. The second fluid passage can comprise a first fuel rail passage and a second fuel rail passage. The fuel system of the present invention can further comprise a first damper connected in fluid communication with the first fuel rail and a second damper connected in fluid communication with the second fuel rail.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
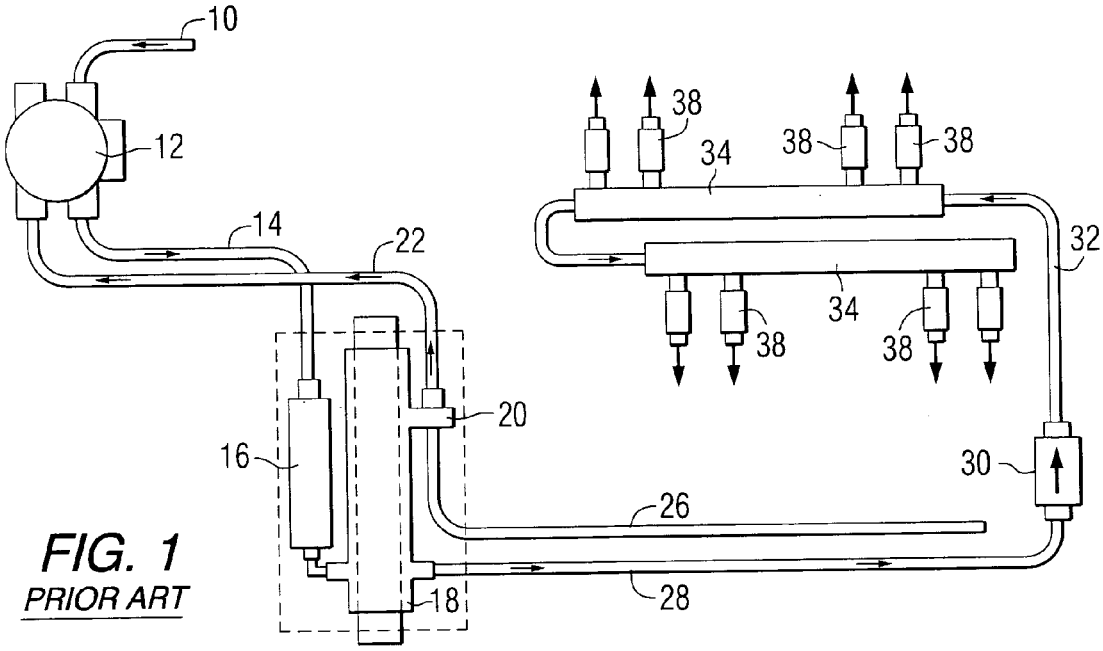
FIG. 1 PRIOR ART
FIGS. 1 and 2 show prior art fuel systems for marine propulsion devices.

Throughout the description of the preferred embodiment of the present invention, like components will be identified by like reference numerals.

Figure 2:
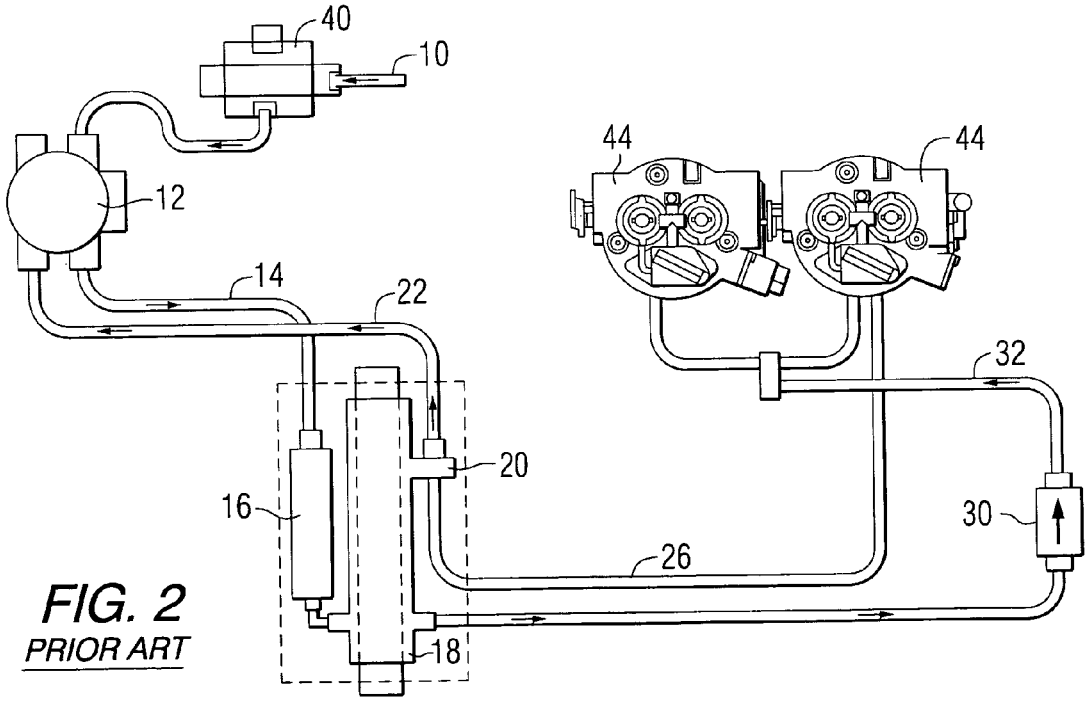
FIG. 2 PRIOR ART

FIGS. 1 and 2 show two known types of fuel systems. In FIG. 1, a fuel line 10 provides fuel from a fuel tank to a water separating fuel filter 12. From the water separating fuel filter 12, a fuel line 14 conducts fuel to an electric fuel pump 16. A heat exchanger 18, or fuel cooler, is attached to a pressure regulator 20 and a fuel line 22 that conducts excess fuel back to the water separating fuel filter 12. A vacuum line 26 provides a reference pressure for the fuel pressure regulator 20. A fuel line 28 conducts fuel from the heat exchanger 18 to a fuel filter 30. After passing through the fuel filter 30, the fuel continues through a fuel line 32 to a pair of fuel rails 34 which are typically associated with two banks of cylinders of an internal combustion engine. A plurality of fuel injectors 38, of which eight are shown in FIG. 1, inject fuel into the cylinders of the engine.

In FIG. 2, the fuel line 10 from the fuel tank conducts fuel which is induced to flow by a mechanical fuel pump 40 through the water separating fuel filter 12. As can be seen, several of the components in FIG. 2 are similar to like components in FIG. 1. In FIG. 2, two throttle bodies 44 receive the flow of fuel through the fuel line 32 from the fuel filter 30. FIGS. 1 and 2 represent known fuel systems used in marine propulsion devices. In FIG. 1, two fuel rails 34 provide fuel to eight fuel injectors 38. In FIG. 2, two throttle bodies 44 are used.

Figure 3:
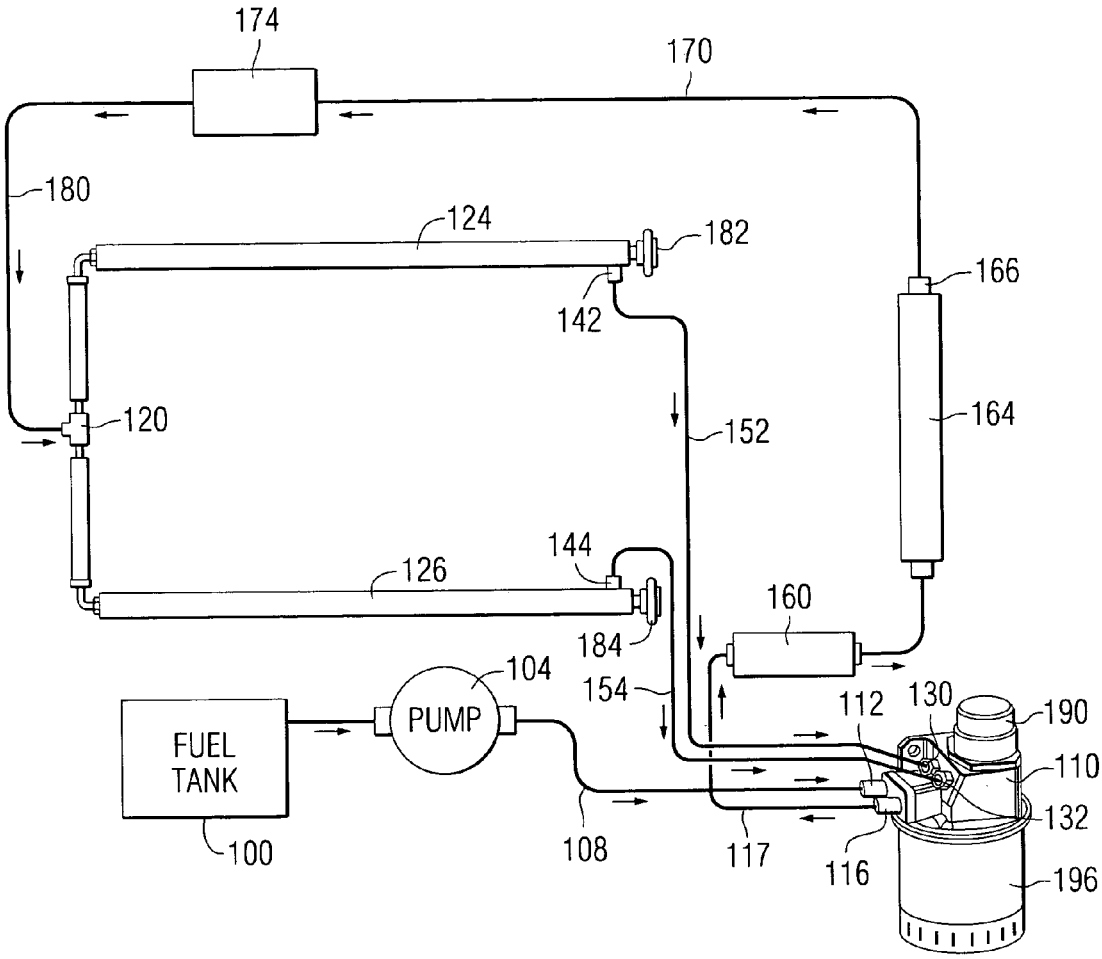
FIG. 3 is a schematic representation of a fuel system for a marine vessel incorporating the present invention.

FIG. 3 is a schematic representation of a fuel system incorporating the present invention. Fuel is drawn from a fuel tank 100 by a mechanical fuel pump 104. Typically, the fuel pump 104 provides fuel through conduit 108 at a pressure of approximately 5–7 psi. A fuel distribution member 110 has a first fluid passage 112 that is connectable in fluid communication with a source of fuel, such as the fuel pump 104 and fuel conduit 108. A second fluid passage 116 is connectable in fluid communication with an inlet 120 of a fuel manifold of the marine propulsion device. In FIG. 3, the fuel manifold comprises a port fuel rail 124 and a starboard fuel rail 126. A return fluid passage, which comprises a first fuel rail return passage 130 and a second fuel rail return passage 132 in FIG. 3, is connectable in fluid communication with an outlet of the fuel manifold. In FIG. 3, the outlet of the fuel manifold comprises a first outlet 142 and a second outlet 144 which are separably connectable to the first and second fuel rail return passages, 130 and 132, by individual conduits which are identified by reference numerals 152 and 154, respectively.

The second fluid passage 116 is connected in fluid communication with a heat exchanger 160 and an electric fuel pump 164. At the outlet 166 of the electric fuel pump 164, pressurized fuel is directed to flow, as represented by arrows 170, through a high pressure fuel filter 174. From the high pressure fuel filter 174, the fuel flows, as represented by arrows 180, to the inlet 120 of the fuel manifold which comprises fuel rails 124 and 126 in FIG. 3. The two fuel rails, 124 and 126, are each provided with dampers, 182 and 184, which are intended to attenuate pressure pulses that could otherwise result from the sequential opening and closing of a plurality of fuel injectors (not shown in FIG. 3).

A pressure regulator 190 is associated with the fuel distribution member 110 in order to maintain a preselected pressure in lines 152 and 154. This preselected pressure, which is typically between 62 psi and 70 psi, results in a regulated pressure existing within the fuel rails, 124 and 126. The preselected pressure is maintained relative to a pressure provided by a conduit (not shown in FIG. 3) connected to the engine in a manner that is generally similar to the way that conduit 26 is described above in conjunction with FIGS. 1 and 2.

With continued reference to FIG. 3, the fuel in line 108 is approximately 5 psi to 7 psi as a result of the mechanical fuel pump 104. The electrical fuel pump 164 is capable, in a typical application, of raising the pressure of the fuel to approximately 100 psi, but the pressure regulator 190 maintains the pressure in the fuel rails to approximately 62 psi to 70 psi. A water separating fuel filter 196 is provided for the purpose of removing both water and certain particles from the fuel. In a typical application of the present invention, the water separating fuel filter 196 is capable of removing particles of approximately 40 microns in size from the fuel passing through it. The high pressure fuel filter 174 is typically capable of further removing particles of approximately 10 microns in size from the fuel.

Figure 4:
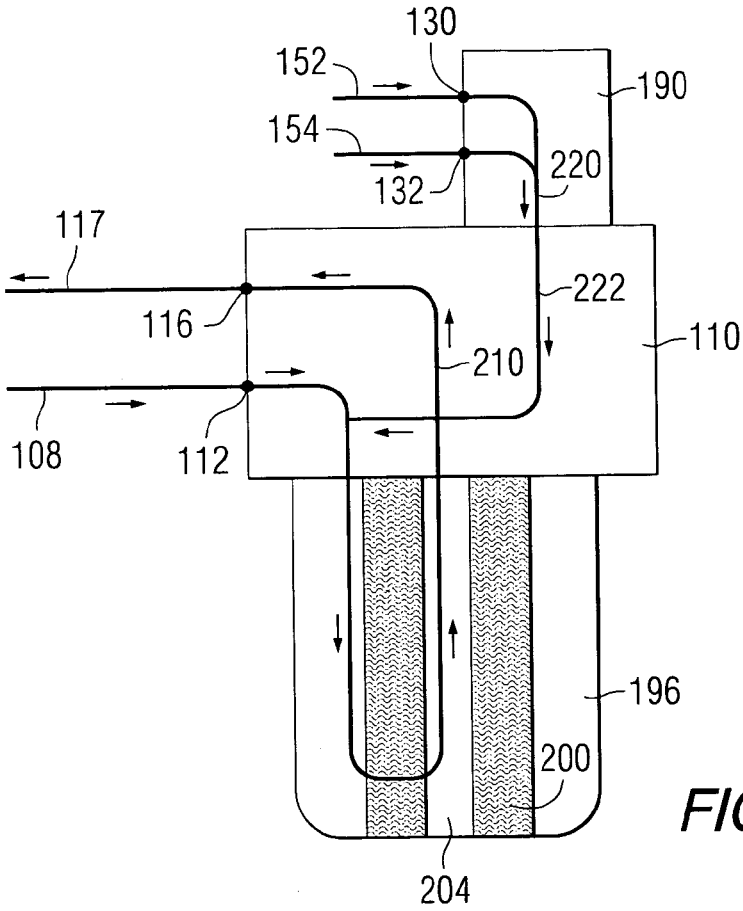
FIG. 4 is a section view through a fuel distribution member, a water separating fuel filter, and a regulator of the present invention.

FIG. 4 is a simplified schematic representation of the fuel distribution member 110, the water separating fuel filter 196, and the regulator 190. The fuel circuit through these components is identified by arrows. More particularly, arrow 108 shows the fuel being conducted to the first fluid passage 112. From there, the fuel passes downwardly through the outer annular passage of the water separating fuel filter 196. The filtering medium 200 is generally annular in shape with a central passage 204 through which filtered fuel can pass upwardly, as represented by arrow 210. After passing through the fuel filter 196, the fuel is directed through the second fluid passage 116 as represented by arrow 117. From there, the fuel passes through the fuel cooler 160, the electric fuel pump 164, and the high pressure fuel filter 174 as described above in conjunction with FIG. 3. It then flows through the inlet 120 of the fuel manifold which comprises the two fuel rails, 124 and 126. After flowing through the fuel rails, fuel which has not been injected into the cylinders returns through lines 152 and 154 to the first and second fuel rail return fluid passages 130 and 132, respectively. These two fuel rail return passages, 130 and 132, are connected together to define a return fluid passage 220. In response to action of the pressure regulator 190, some fuel may flow along arrow 222 in FIG. 4 when the pressure within the fuel rails, 124 and 126, exceeds the set pressure of the regulator 190. This excess fuel is returned to the inlet of the fuel filter 196 and is recirculated.

Figure 5:
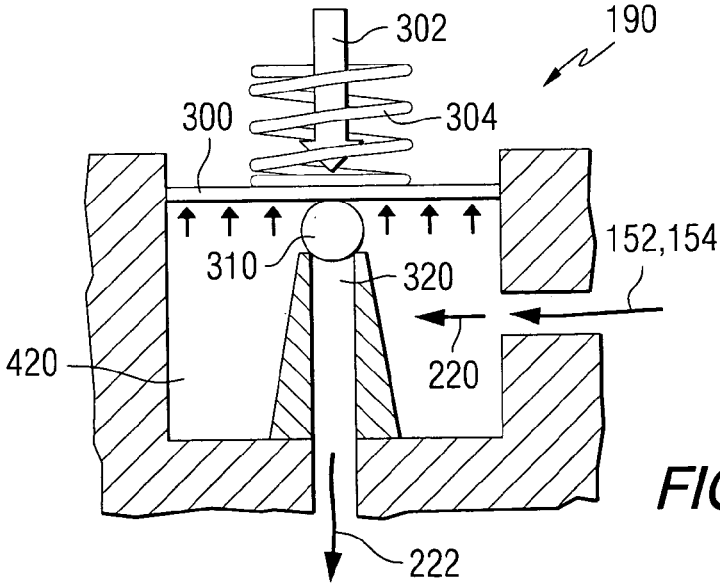
FIG. 5 is a section view showing the location of a pressure regulator within the fuel distribution member of the present invention.

FIG. 5 is a highly schematic representation of the operation of the pressure regulator 190. A diaphragm 300 is urged downwardly, as represented by arrow 302, by a spring 304. This downward pressure, in turn, forces a spherical component 310 into flow blocking arrangement with a conduit 320. The fuel flowing through the first and second fuel rail return passages, 130 and 132, as represented by arrows 152 and 154, are combined as represented by arrow 122 in FIG. 5. This fuel flows into the region below the diaphragm 300. If the pressure of the fuel within the cavity below the diaphragm 300 creates an upward force (as represented by the upwardly directed arrows in FIG. 5) that exceeds the force of the spring 304, the sphere 310 will be raised and fuel will flow through the conduit 320 as represented by arrow 222. This is a highly simplified schematic representation of the operation of the pressure regulator 190.

Figure 6:
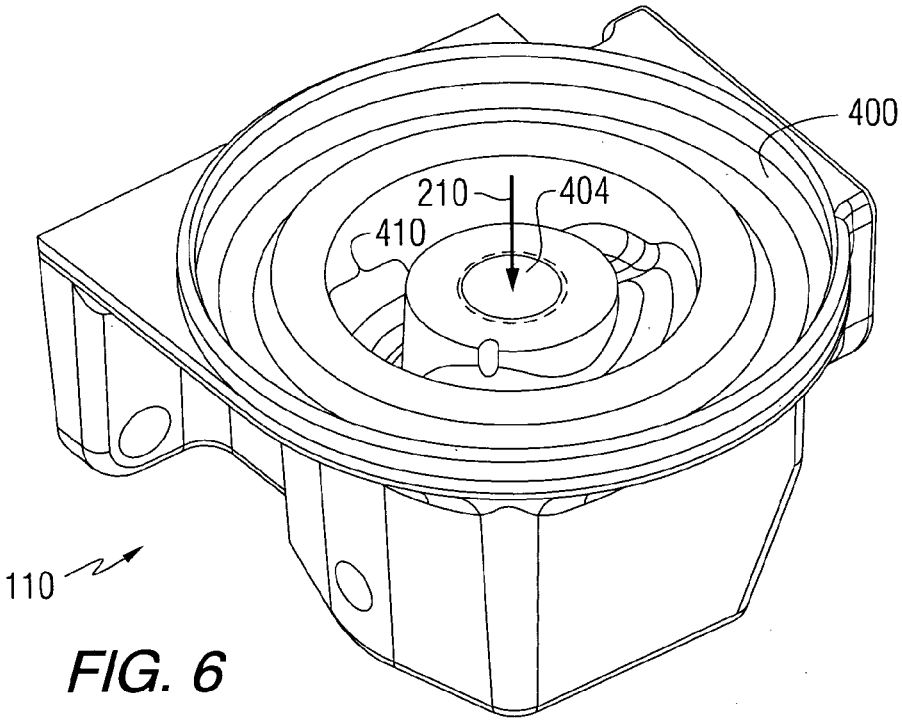
FIGS. 6 and 7 are isometric views of the fuel distribution member of the present invention.

FIG. 6 is an isometric bottom view of the fuel distribution member 110, showing a filter attachment opening 400. Although not clearly shown in FIG. 6, it should be understood that one or more openings are provided in the annular channel 410 surrounding the passage 404 in order to allow fuel to flow from the fuel distribution member 110 into the outer annular passage of the water separating fuel filter 196 surrounding the filter media 200, as described above in conjunction with FIG. 4.

Figure 7:
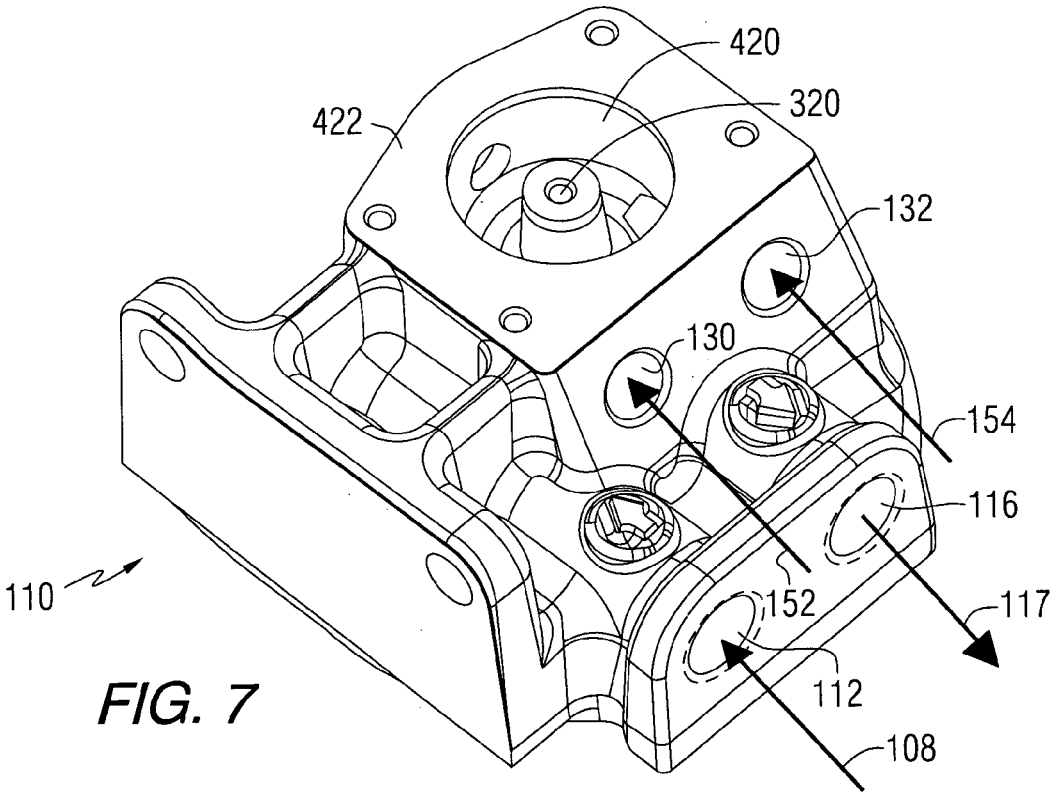

FIG. 7 shows an isometric top view of the fuel distribution member 110 showing the opening into which the diaphragm 300, as described above in conjunction with FIG. 5, of the pressure regular 190 is disposed. It should be understood that the pressure regulator 190 is attached to the surface 422 show in FIG. 7. The pressure relief conduit 320 is shown in FIG. 7 without the sphere 310 disposed over it. However, in FIGS. 5 and 7, it can be seen that pressure within the chamber 420 would cause the diaphragm 300 to raise the sphere 310 out of blocking relation with conduit 320 to allow excess pressure to pass along the path identified by arrow 222. Also shown in FIG. 7 are the first fluid passage 112, which is connectable in fluid communication with a source of fuel, such as the fuel pump 104 described above in conjunction with FIG. 3. The second fluid passage 116 is connectable to an inlet 120 of the fuel manifold system. The first and second fuel rail return fluid passages, 130 and 132, are shown in FIG. 7.

Figure 8:
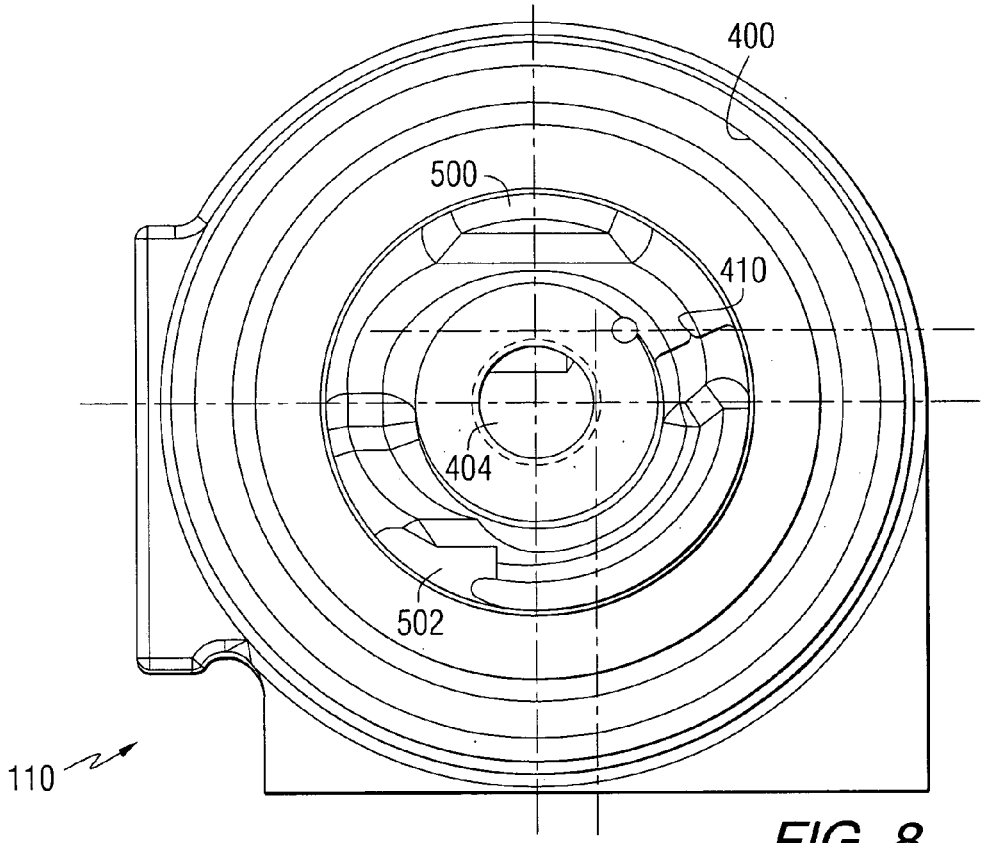
FIG. 8 is a bottom view of the fuel distribution member of the present invention.

FIG. 8 is a bottom view of the fuel distribution member 110, showing the filter attachment opening 400. Also shown is the central conduit 404 which is associated with the central passage 204 of the filter medium 200 used in the water separating fuel filter 196, as described above in conjunction with FIG. 4. Openings 500 and 502 provide a fuel passage to conduct fuel from the first fluid passage 112 to the outer annular portion of the water separating fuel filter 196, which surrounds the media 200, as described above in conjunction with FIG. 4.

Figure 9:
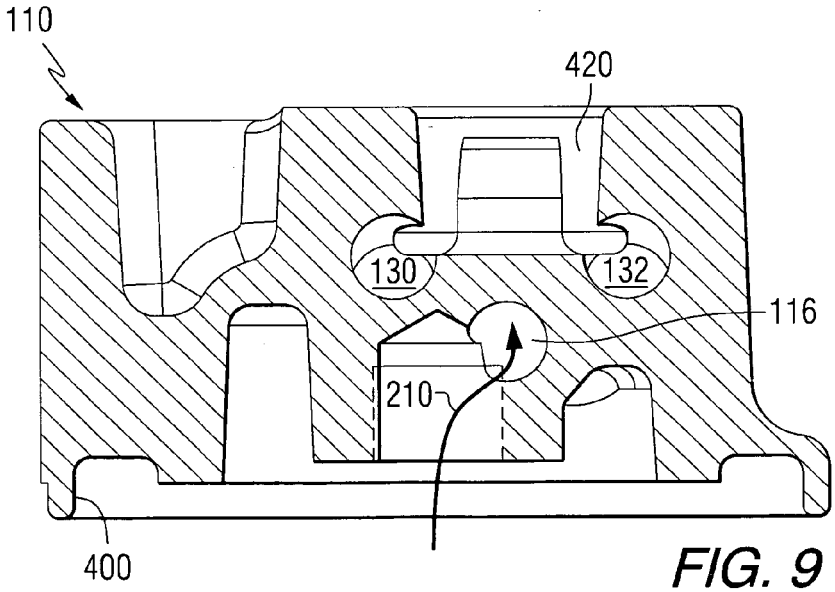
FIG. 9 is a section view of the fuel distribution member of the present invention.

FIG. 9 is a section view of the fuel distribution member 110 showing the annular cavity 420 surrounding the pressure relief conduit 320, which was described above in conjunction with FIG. 5. The first and second fuel rail return fluid passages, 130 and 132, are shown connected in fluid communication with the annular chamber 420 to allow the fuel returning from the fuel rails to be conducted into the chamber 420 below the diaphragm 300, as described above.

With continued reference to FIGS. 3–9, it can be seen that a fuel system for a marine propulsion device, made in accordance with the preferred embodiment of the present invention, comprises a fuel distribution member 110 having a first fluid passage 112 which is connectable in fluid communication with a source of fuel, such as the fuel pump 104 and fuel tank 100. A second fluid passage 116 is connectable in fluid communication with an inlet 120 of a fuel manifold which can comprise fuel rails, 124 and 126, of a marine propulsion device. A return fluid passage, 130 and 132, is connectable in fluid communication with an outlet, 142 and 144, of the fuel manifold of the marine engine. A pressure regulator 190 is attached to the fuel distribution member and disposed in pressure regulating relation with a fuel pressure regulation fluid passage. A filter attachment opening 400 is formed in the fuel distribution member 110 and shaped to receive a water separating fuel filter 196. A filter outlet passage, 500 and 502, is formed in the fuel distribution member 110 and is connectable in fluid communication with an inlet of the fuel filter 196, to conduct fuel to an outer annular passage surrounding filter media 200 within the filter 196. A filter inlet passage 404 is formed in the fuel distribution member 110 and is connectable in fluid communication with an outlet of the fuel filter 196 near a central portion 204 of the filter media 200.

The low pressure fuel pump 104 is connected in fluid communication with the first fluid passage 112 between a source of fuel 100 and the fuel distribution member 110. A fuel cooler 160 is connected in fluid communication with the second fluid passage 116 between the fuel distribution member 110 and the fuel manifold of the marine propulsion device, which comprises fuel rails 124 and 126. A high pressure fuel pump 164 is connected in fluid communication with the second fluid passage 116 between the fuel distribution member 110 and the fuel manifold. A high pressure fuel filter 174 is connected in fluid communication with the second fluid passage 116 between the fuel distribution member 110 and the fuel manifold. A low pressure fuel filter 196 is attached to the filter attachment opening 400. The fuel manifold comprises first and second fuel rails, 124 and 126, which are connected in fluid communication with the second fluid passage 116. The return fluid passage comprises a first fuel rail return fluid passage and a second fuel rail return fluid passage, 130 and 132, respectively. First and second dampers 182 and 184, are connected in fluid communication with the first and second fuel rails, 124 and 126.

Although the present invention has been described with particular specificity and illustrated to show a preferred embodiment, it should be understood that alternative embodiments are also within its scope.

We claim:

1. A fuel system for a marine propulsion device, comprising:

a fuel distribution member having a first fluid passage which is connectable in fluid communication with a source of fuel, a second fluid passage which is connectable in fluid communication with an inlet of a fuel manifold of said marine propulsion device, a return fluid passage which is connectable in fluid communication with an outlet of said fuel manifold of said marine propulsion device and a fuel pressure regulation fluid passage;

a pressure regulator attached to said fuel distribution member and disposed in pressure regulating relation with said fuel pressure regulation fluid passage;

a filter attachment opening, formed in said fuel distribution member, which is shaped to receive a fuel filter;

a filter outlet passage, formed in said fuel distribution member, which is connectable in fluid communication with an inlet of said fuel filter; and a filter inlet passage formed in said fuel distribution member which is connectable in fluid communication with an outlet of a fuel filter.

2. The fuel system of claim 1, further comprising:

a low pressure fuel pump connected in fluid communication with said first fluid passage between said source of fuel and said fuel distribution member.

3. The fuel system of claim 1, further comprising:

a fuel cooler connected in fluid communication with said second fluid passage between said fuel distribution member and said fuel manifold of said marine propulsion device.

4. The fuel system of claim 1, further comprising:

a high pressure fuel pump connected in fluid communication with said second fluid passage between said fuel distribution member and said fuel manifold of said marine propulsion device.

5. The fuel system of claim 1, further comprising:

a high pressure fuel filter connected in fluid communication with said second fluid passage between said fuel distribution member and said fuel manifold of said marine propulsion device.

6. The fuel system of claim 1, further comprising:

a low pressure fuel filter attached to said filter attachment opening.

7. The fuel system of claim 1, wherein:

said fuel manifold of said marine propulsion device comprises first and second fuel rails connected in fluid communication with said second fluid passage.

8. The fuel system of claim 7, wherein:

said return fluid passage comprises a first fuel rail return fluid passage and a second fuel rail return fluid passage.

9. The fuel system of claim 7, further comprising:

a first damper connected in fluid communication with said first fuel rail and a second damper connected in fluid communication with said second fuel rail.

10. A fuel system for a marine propulsion device, comprising:

a fuel distribution block having a first fluid passage which is connectable in fluid communication with a source of fuel, a second fluid passage which is connectable in fluid communication with an inlet of a fuel manifold of said marine propulsion device, a return fluid passage which is connectable in fluid communication with an outlet of said fuel manifold of said marine propulsion device and a fuel pressure regulation fluid passage, said fuel manifold of said marine propulsion device comprising first and second fuel rails connected in fluid communication with said second fluid passage;

a pressure regulator attached to said fuel distribution member and disposed in pressure regulating relation with said fuel pressure regulation fluid passage;

a filter attachment opening, formed in said fuel distribution member, which is shaped to receive a fuel filter;

a low pressure fuel pump connected in fluid communication with said first fluid passage between said source of fuel and said fuel distribution member;

a filter outlet passage, formed in said fuel distribution member, which is connectable in fluid communication with an inlet of said fuel filter; and a filter inlet passage formed in said fuel distribution member which is connectable in fluid communication with an outlet of a fuel filter.

11. The fuel system of claim 10, further comprising:

a fuel cooler connected in fluid communication with said second fluid passage between said fuel distribution member and said fuel manifold of said marine propulsion device.

12. The fuel system of claim 11, further comprising:

a high pressure fuel pump connected in fluid communication with said second fluid passage between said fuel distribution member and said fuel manifold of said marine propulsion device.

13. The fuel system of claim 12, further comprising:

a high pressure fuel filter connected in fluid communication with said second fluid passage between said fuel distribution member and said fuel manifold of said marine propulsion device; and a low pressure fuel filter attached to said filter attachment opening.

14. The fuel system of claim 13, wherein:

said return fluid passage comprises a first fuel rail return fluid passage and a second fuel rail return fluid passage.

15. The fuel system of claim 14, further comprising:

a first damper connected in fluid communication with said first fuel rail and a second damper connected in fluid communication with said second fuel rail.

16. A fuel system for a marine propulsion device, comprising:

a fuel distribution block having a first fluid passage which is connected in fluid communication with a source of fuel, a second fluid passage which is connected in fluid communication with an inlet of a fuel manifold of said marine propulsion device, a return fluid passage which is connected in fluid communication with an outlet of said fuel manifold of said marine propulsion device and a fuel pressure regulation fluid passage, said fuel manifold of said marine propulsion device comprising first and second fuel rails connected in fluid communication with said second fluid passage;

a pressure regulator attached to said fuel distribution member and disposed in pressure regulating relation with said fuel pressure regulation fluid passage;

a filter attachment opening, formed in said fuel distribution member, which is shaped to receive a fuel filter;

a filter outlet passage, formed in said fuel distribution member, which is connectable in fluid communication with an inlet of said fuel filter; and a filter inlet passage formed in said fuel distribution member which is connectable in fluid communication with an outlet of a fuel filter.

17. The fuel system of claim 16, further comprising:

a fuel cooler connected in fluid communication with said second fluid passage between said fuel distribution member and said fuel manifold of said marine propulsion device.

18. The fuel system of claim 17, further comprising:

a high pressure fuel pump connected in fluid communication with said second fluid passage between said fuel distribution member and said fuel manifold of said marine propulsion device; and a low pressure fuel pump connected in fluid communication with said first fluid passage between said source of fuel and said fuel distribution member.

19. The fuel system of claim 18, further comprising:

a high pressure fuel filter connected in fluid communication with said second fluid passage between said fuel distribution member and said fuel manifold of said marine propulsion device; and a low pressure fuel filter attached to said filter attachment opening.

20. The fuel system of claim 19, further comprising:

a first damper connected in fluid communication with said first fuel rail and a second damper connected in fluid communication with said second fuel rail, said second fluid passage comprises a first fuel rail passage and a second fuel rail passage.

* * * * *